United States Patent [19]

Feistkorn et al.

[11] 4,259,908

[45] Apr. 7, 1981

[54] ELECTROMAGNETIC SUSPENSION VEHICLE

[75] Inventors: Jochen Feistkorn, Gröbenzell; Edgar Pohlmann; Walter Rothmayer, both of Munich; Peter Schwärzler, Fürstenfeldbruck; Günter Steinmetz, Grafing; Peter Zander, Grossinzemoos, all of Fed. Rep. of Germany

[73] Assignee: Krauss-Maffei AG, Munich, Fed. Rep. of Germany

[21] Appl. No.: 59,053

[22] Filed: Jul. 19, 1979

[51] Int. Cl.[3] ..... B61B 13/08

[52] U.S. Cl. ..... 104/281; 104/284; 104/286; 104/294

[58] Field of Search ..... 104/281, 291, 284, 286

[56] References Cited

U.S. PATENT DOCUMENTS

| | | | |
|---|---|---|---|
| 3,626,858 | 12/1971 | Colling et al. | 104/291 |
| 3,780,668 | 12/1973 | Schwarzler et al. | 104/286 |
| 3,797,403 | 3/1974 | Schwarzler et al. | 104/304 |
| 3,820,472 | 6/1974 | Schwarzler et al. | 104/294 |
| 3,865,043 | 2/1975 | Schwarzler et al. | 104/294 |
| 3,937,148 | 2/1976 | Simpson | 104/284 |
| 3,937,149 | 2/1976 | Winkle et al. | 104/286 |
| 3,964,398 | 6/1976 | Breitling | 104/130.1 |
| 3,967,561 | 7/1976 | Schwarzler et al. | 104/294 |
| 3,968,753 | 7/1976 | Breitling | 104/130.1 |
| 4,029,020 | 6/1977 | Nakamura et al. | 104/284 |

*Primary Examiner*—Richard A. Bertsch
*Attorney, Agent, or Firm*—Karl F. Ross

[57] ABSTRACT

An electromagnetic suspension vehicle has an electromagnet system for suspending and guiding the vehicle along a track, the electromagnet being elastically suspended so as to be able to move generally parallel to itself transversely of the direction of travel.

6 Claims, 3 Drawing Figures

FIG. 2
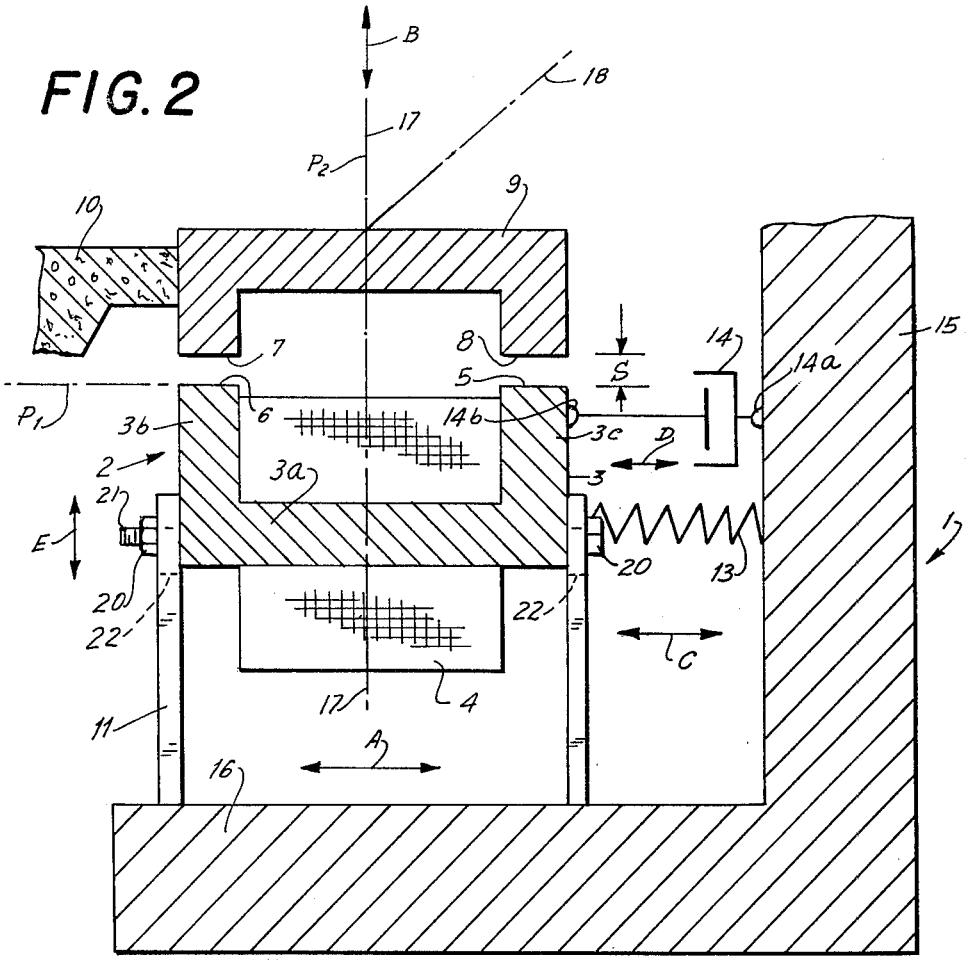
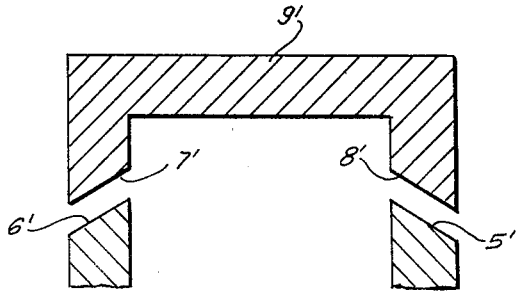
FIG. 3

ELECTROMAGNETIC SUSPENSION VEHICLE

FIELD OF THE INVENTION

The present invention relates to improvements in electromagnetic suspension vehicles and, more particularly, to a suspension system for the contactless support and guidance of a vehicle along a track.

BACKGROUND OF THE INVENTION

Electromagnetic-suspension and electromagnetic-levitation vehicle systems generally comprise a track having a plurality of substantially continuous rails cooperating with respective magnetic support and guidance units upon the vehicle. Usually a reaction rail on the track cooperates with a linear induction motor on the vehicle to propel the vehicle along the track while the electromagnetic suspension guidance system maintains the vehicle at a given clearance from the track. Other devices associated with the system can include a contact rail cooperating with shoes on the vehicle for delivering electric current to the vehicle or for electrical control and signaling purposes; the track being formed by a plurality of uprights interconnected by a support, e.g. of concrete, along which the various rails are mounted. The vehicle can have support portions which carry the magnet system etc.

Electromagnetic arrangements for the contactless support and guidance of a magnetic levitation vehicle generally include an armature rail which may be of inverted-U section mounted along the track and extending continuously in a longitudinal direction corresponding to the direction of travel of the vehicle. The two shanks of the U are formed with pole surfaces or faces which are spacedly juxtaposed with corresponding pole faces of the core of an electromagnet mounted on the vehicle, this core being likewise of U-section.

The magnetic field between the core and the armature rail, generally by the electrical energization of a coil around the core, provides a magnetic force supporting the vehicle against the downwardly acting force of gravity, the predetermined spacing between the pair of pole faces in the vertical direction being maintained by the corresponding electrical circuitry.

Such systems can include a row of electromagnets on each side of the vehicle for the support and guidance functions.

Conventional magnetic levitation vehicles of the aforedescribed type, for example, the TRANSRAPID system of Krauss-Maffei, Munich, Germany, generally make use of one row of electromagnets on each side of the vehicle to provide the vertical support function and a second row of electromagnets acting independently of the first or in conjunction with the first to provide the desired lateral guide function.

In other words, a magnetic force is generated by virtue of the presence of a second row of electromagnets to counteract centrifugal forces during travel of the vehicle along curves, wind forces and the like acting transversely to the direction of travel.

When two rows of electromagnets are provided on each side of the vehicle to form a combined support and guidance system, the magnets are rigidly connected with the pedestals or undercarriage of the vehicle on which they are mounted.

Customarily, lateral guidance requires energization of the magnet acting in the left-hand and the right-hand directions to different degrees continuously along the travel path of the vehicle.

While this system functions effectively, a problem with it is that the additional row of electromagnets provided on each side of the vehicle to provide the lateral guidance function has considerable mass. When, in an extreme case, the electromagnets of one row are energized maximally and the electromagnets on the other row are energized minimally for a given guidance condition, the supporting force may be found to carry it mostly by only half the number of magnets provided so that at least the more energized side of the electromagnet system may be incapable of carrying the load.

OBJECTS OF THE INVENTION

It is the principal object of the present invention to provide an electromagnetic suspension and guidance system having a reduced magnet weight for a given suspension load capability.

Another object of the invention is to provide an improved electromagnetic suspension system, for a magnetic levitation vehicle, which will provide the requisite guidance of the vehicle while maintaining as much as possible a uniform loading and energization of all magnets and will prevent overloading of individual magnets even with high operating forces.

Another object of the invention is to provide an improved vehicle capable of operating with high loads and forces but without the disadvantages of earlier vehicle systems.

SUMMARY OF THE INVENTION

These objects and others which will become apparent hereinafter are attained, in accordance with the present invention, in an electromagnetic suspension system for a magnetic levitation vehicle of the type described wherein the pole faces of the suspension-magnet pole are juxtaposed directly with the pole surfaces of the armature rail and are centered in such direct juxtaposition by elastic means enabling the deflection of the electromagnet substantially parallel to a plane of the pole surface with such motion being damped. Any deviation from the direct juxtaposition or centering of one of the electromagnets will thus result in a force upon the vehicle tending to restore such centered juxtaposition, thereby affording lateral guidance of the vehicle.

According to a feature of the invention, the pole surfaces or faces are all substantially perpendicular to the vertical although, in accordance with another feature of the invention, the pole surfaces can include arcuate angles with the vertical.

In one embodiment of the invention, at least one electromagnet of the row of electromagnets on each side of the vehicle is supported by leaf springs which extend perpendicularly to the pole faces and which are connected to the frame or chassis of the vehicle. Between another portion of the vehicle frame or chassis and this electromagnet an oscillation damper, e.g. a dashpot, is provided and a spring can also be connected to the electromagnet to bias it into its centered position. Both the dashpot and the spring are preferably effective in directions substantially parallel to the planes of the pole faces.

Alternatively, the electromagnet can be suspended by rubber or other elastomeric members.

Furthermore, at least one of the electromagnets can be mounted so that it can be adjusted substantially perpendicularly to the planes of the pole faces relative to the vehicle.

According to the present invention, therefore, all of the magnets on each side of the vehicle can be disposed in a single row along a common axis without relative lateral offset, this axis lying in the plane of symmetry of the armature rail which extends in the direction of travel.

The restoring force centering the vehicle upon encountering a lateral force tending to shift one of the magnets off center, is thus generated by the aforementioned spring or intrinsic elasticity of the damping elastomeric members. The present invention thus provides both lateral repositioning of the vehicle and the necessary support for the magnetic levitation thereof.

Lateral movements are damped and, in addition, a relatively soft coupling is provided between the vehicle and the track.

BRIEF DESCRIPTION OF THE DRAWING

The above and other objects, features and advantages of the present invention will become more readily apparent from the following description, reference being made to the accompanying drawing in which:

FIG. 2 is a detail view of another electromagnetic suspension system; and

FIG. 3 illustrates another embodiment of the invention.

SPECIFIC DESCRIPTION

Figure 1:
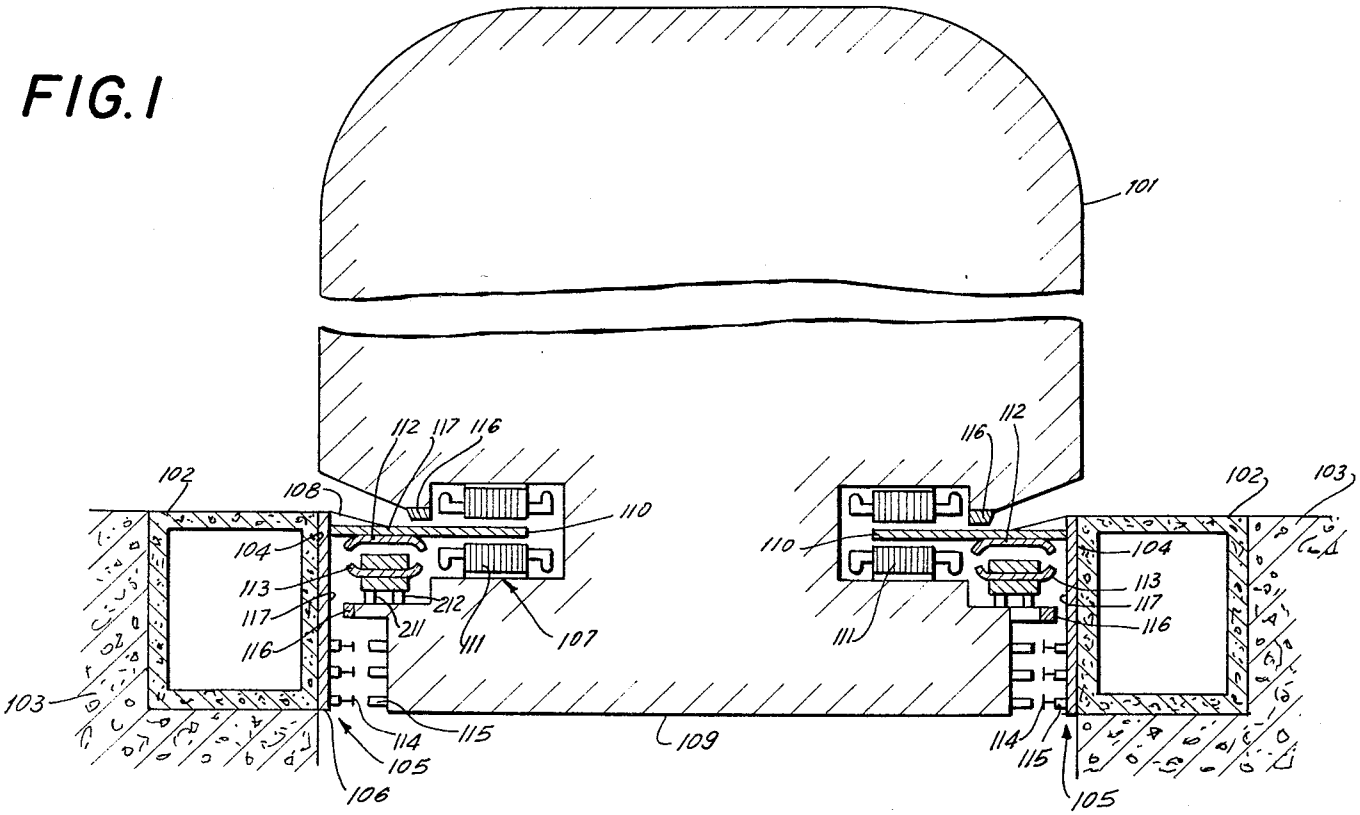
FIG. 1 is a cross-sectional view through a track and vehicle system illustrating principles of the present invention.

FIG. 1 shows a vehicle 101 which can be of the type described in U.S. Pat. No. 3,937,149 and which can have its track constituted as described in U.S. Pat. Nos. 3,964,398 and 3,968,753 or the applications and/or patents mentioned therein. Reference may also be had to U.S. Pat. No. 3,967,561 and the patents mentioned therein for details of the linear induction motor used to operate the vehicle system.

More specifically, the magnetic suspension vehicle 101 is displaceable along a track defined by a pair of hollow parallel rail-support beams 102 which can be composed of reinforced concrete and mounted upon a pylon structure represented generally at 103 and not otherwise shown in detail here.

The lateral flank 104 of each support beam can carry a rail assembly generally shown at 105 which includes a support rail 106 (see U.S. Pat. No. 3,937,149).

In the embodiment illustrated in FIG. 1, vehicle 101 is shown to be provided on its undercarriage 109 with a linear induction motor 107 of the double-sided type (although a single-sided motor may be used as shown in U.S. Pat. No. 3,967,561), the stator stacks 111 here being disposed above and below a reaction rail 110 of electrically conductive metal, e.g. copper or aluminum.

Details of the construction and operation of such an induction motor may be found in U.S. Pat. No. 3,820,472.

Along the outer edges of the reaction rail 110 there are welded to the upper portion of the vehicle support rails 106 which are stiffened relative thereto by triangular webs 108 which lie in vertical planes spaced apart along the rails. The reaction rail here extends horizontally between the stator stacks 111 of the linear induction motor.

Between the active free ends of the reaction rail 110 and their anchored portions, there is provided on the underside of each reaction rail a downwardly open channel-shaped armature rail 112 of U profile, i.e. of magnetically attractable material and forming a part of the magnetic suspension and guide system.

For details of this armature rail, reference may be had to U.S. Pat. Nos. 3,797,403 and 3,780,668.

The undercarriage 109 of the vehicle is provided with outwardly extending ledges having upwardly facing surfaces upon which are mounted rows of electromagnets 113 on each side of the vehicle, these electromagnets having cores whose profiles correspond to that of the juxtaposed armature 112 so that the poles of the armature rails 112 are aligned with the poles of the electromagnetic cores (see the discussion with respect to FIG. 2 below).

According to the present invention, each electromagnet 113 is mounted on a pair of pedestals 211 and 212 which are elastomeric and serve to bias the vehicle relative to the electromagnet (or vice versa), to maintain the centered condition and simultaneously act as dampers.

To support the vehicle against failure of the electromagnetic suspension or guide forces, e.g. if the electric current supply fails, the rail assembly 106, 108, 110, 112, 114 can be provided with longitudinal extending zones or rails 114 which are engageable by emergency rails 116 of the vehicle.

Along the bottom of the support rail 106 there are provided three current-carrying rails 114 which cooperate with the diagrammatically illustrated contact shoes 115 to deliver current to the vehicle. The rails may be of the type described in U.S. Pat. No. 3,937,149. The gap between the pole faces may be maintained by the circuitry described in application Ser. No. 297,035 filed Oct. 4, 1972 (U.S. Pat. No. 3,865,043 issued Feb. 11, 1975) and mentioned in U.S. Pat. No. 3,937,149.

In FIG. 2 we have shown an electromagnet 2 of one row of electromagnets along one side of the vehicle 1 which has a diagrammatically illustrated coil 4 and a U-shaped ferromagnetic iron core 3 constituted as a yoke **3*a* with a pair of shanks 3*b* and 3*c* forming the pole faces 5 and 6 which lie generally in a plane $P_1$ perpendicular to the plane $P_2$ which extends in the direction of vehicle travel and corresponds to the symmetry plane of the electromagnet. It also includes the axis 18** and extends in the direction of travel of the vehicle which is perpendicular to the plane of the paper.

The pole faces 5 and 6 are juxtaposed and register in the normal rest position of the electromagnet with the pole faces 7 and 8 of a ferromagnetic U-shaped armature rail 9 which is connected to the track 10 as shown diagrammatically in FIG. 2.

According to the invention, the electromagnet 2 is connected by two leaf springs 11 and 12 to the laterally extending support arm 16 of the undercarriage of vehicle 1 to allow relative lateral movement of the vehicle and electromagnet in the direction of arrow A, i.e. parallel to the planes $P_1$ of the pole faces 5 and 6.

The main magnet force is applied in the direction of arrow B, i.e. parallel to the axis 17 and to the plane $P_2$ and the current through the electromagnet is maintained so that the gap s between the pole faces has a constant value.

Between the electromagnet 2 and the longitudinal shank 15 of the undercarriage or support arm of the vehicle 1, there is provided a compression spring 13 and, similarly, a diagrammatically indicated dashpot-type oscillation damper 14 is pivotally connected at 14*a* and 14*b* to the electromagnet and to the undercarriage of the vehicle. The spring 13 and the oscillation damper 14 are effective in the direction of the arrows C and D, i.e. generally perpendicular to the axis 17 and to the longitudinal axis 18 of the armature rail 9. When the leaf springs 11 and 12 have a sufficient stiffness, the restoring spring 13 can be eliminated.

In the illustrated rest position of the electromagnet system of the vehicle, the pole faces 5 and 6 are directly aligned with the pole faces 7 and 8, i.e. the electromagnet and the armature rail are centered. When lateral forces are applied to divert the vehicle onto a spur of the main track, for example, or to compensate for centrifugal forces on turns or for wind forces, the magnet 2 shifts relative to the vehicle parallel to the plane of approach and magnetic restoring forces are generated which are transferred via the springs 11 through 13 and the damper 14 to the vehicle.

By contrast with a rigid connection of the magnet on the vehicle, in which relative movements between the vehicle and the magnet cannot occur, spring and damper actions dissipate the lateral oscillation between the vehicle and the magnet.

FIG. 2 also shows that the magnet 2 can be adjusted vertically by arrow E relative to the vehicle 1 by the loosening of nuts 20 to allow respective bolts 21 to slide in slots 22 of the leaf spring.

FIG. 3 shows another orientation of the armature relative to the electromagnet core and indicates that the pole faces 7' and 8' of the armature rail 9' can be inclined to the vertical as can the pole faces 5' and 6', the system otherwise being constituted as described in connection with FIG. 2.

We claim:

1. An electromagnetic-suspension vehicle system comprising in combination:

a track formed with at least one armature rail extending longitudinally along said track in a direction of displacement and having a pair of pole surfaces;

a vehicle displaceable along said track, said vehicle being formed with a support extending along said rail;

a row of electromagnets on said vehicle for electromagnetically suspending said vehicle from said track, said rail having a pair of pole faces turned toward said electromagnet, said electromagnet having a pair of pole faces turned toward said rail said row, being centered relative to said rail with the pole faces of the electromagnet registering with but spaced from the pole faces of the rail; and spring-and-damper means between said electromagnet and said support for enabling at least limited relative movement of the vehicle and the electromagnet in a plane parallel to a plane of said pole faces, said spring-and-damper means including a pair of leaf springs extending between said electromagnet and said support in a direction perpendicular to said plane, and a restoring spring connected between said support and said electromagnet and effective in a direction parallel to said plane.

2. The system defined in claim 1 wherein the pole faces of said electromagnets lie in a plane perpendicular to the vehicle.

3. The system defined in claim 2, further comprising means for adjustably shifting said electromagnet substantially perpendicular to said plane relative to said vehicle.

4. The system defined in claim 1 wherein the pole faces of said electromagnet are inclined to the vehicle.

5. The system defined in claim 1 wherein said spring-and-damper means includes a dashpot damper connected between said electromagnet and said support and effective in a direction parallel to said plane.

6. The system defined in claim 1 wherein the spring-and-damper means includes a plurality of elastomeric members mounting said electromagnet on said support.

* * * * *